United States Patent [19]

Takeda et al.

[11] 4,336,007

[45] Jun. 22, 1982

[54] WORM TYPE COMPRESSOR WITH COMPRESSED FLUID ESCAPE GROOVES

[75] Inventors: Kenji Takeda, Okazaki; Yoshiyuki Hattori, Toyoake; Takao Kasagi, Okazaki, all of Japan

[73] Assignee: Nippon Soken, Inc., Nishio, Japan

[21] Appl. No.: 122,052

[22] Filed: Feb. 15, 1980

[30] Foreign Application Priority Data

Mar. 13, 1979 [JP] Japan ..... 54-31868[U]

[51] Int. Cl.[3] ..... F04C 18/00; F04C 29/08

[52] U.S. Cl. ..... 418/183; 418/189; 418/226

[58] Field of Search ..... 418/161-163, 418/183, 189, 226

[56] References Cited

U.S. PATENT DOCUMENTS 2,141,982 12/1938 Good ..... 418/226
2,254,938 9/1941 Dick et al. ..... 418/189

FOREIGN PATENT DOCUMENTS 509372 7/1939 United Kingdom ..... 418/226
746628 3/1956 United Kingdom ..... 418/189

*Primary Examiner*—John J. Vrablik
*Attorney, Agent, or Firm*—Cushman, Darby & Cushman

[57] ABSTRACT

A worm type compressor comprises a cylindrical worm provided with a plurality of spiral-like passages in its inner periphery for forming fluid sealing chambers, a rotor slidably disposed within the worm and provided with an internal fluid outlet opening for discharging a compressed fluid and a pinion gear disposed within the rotor so as to be rotated about an axis perpendicular to and away from the rotor axis while engaged with the spiral-like passages.

A worm type compressor further comprises a compressed fluid escape means which is provided in each of the finishing portions of the spiral-like passages of the worm for letting the compressed fluid escape from each of the spiral-like passages in the final stage of the fluid compressing step.

Fluid introduced within the worm is compressed in the fluid sealing chambers as the pinion gear rotates and the compressed fluid is discharged through an internal fluid outlet port perforated in the outer periphery of the rotor without generating abnormally high pressure or noise.

3 Claims, 5 Drawing Figures

WORM TYPE COMPRESSOR WITH COMPRESSED FLUID ESCAPE GROOVES

BACKGROUND OF THE PRESENT INVENTION

The present invention relates to a worm type compressor for compressing gaseous fluid such as air, refrigerant gas, etc. therein.

The present invention provides a small-sized worm type compressor having the above described construction which operates silently and exhibits excellent durability.

Hereinafter, gaseous fluid will be called "fluid."

We, inventors, have developed a small-sized worm type fluid rotating machine (Japanese patent application No. 39940/1978, U.S. patent application Ser. No. 26,730 now abandoned).

According to the above machine, a worm is composed of a cylindrical body provided with a plurality of spiral-like passages in its inner periphery and a rotor is coaxially and slidably inserted within the worm. And within the rotor, a pinion gear is provided so as to rotate about an axis perpendicular to and spaced from the axis of the rotor. In the outer periphery of the pinion gear, teeth are formed. One portion of the teeth of the pinion gear is projected from the rotor to be engaged with the spiral-like passages of the worm. Thus, fluid sealing chambers are formed by the spiral-like passages of the worm, teeth of the pinion gear and the outer periphery of the rotor. As the worm and the rotor are relatively rotated, the teeth of the pinion gear travel within the spiral-like passages, and the volume of each of fluid sealing chambers is varied to compress the fluid therein.

In the worm type fluid rotating machine having the above described construction, an internal fluid outlet port opens at the outer periphery of the rotor so as to be opposed to each of the finishing ends of the fluid compressing side of the spiral-like passages. And when the rotor and the worm are relatively rotated, the internal fluid outlet port passes each of the finishing ends of the spiral-like passages in turn and immediately after that time, each of the teeth of the pinion gear which travels within the spiral-like passages, compressing the fluid therewithin, passes each of the finishing ends of the spiral-like passages.

The worm type rotating machine having the above construction has the drawback that one portion of the fluid which is compressed by each of the teeth of the pinion gear and is discharged from the internal fluid outlet port, leakes into the low pressure side of each of teeth of the pinion gear in the final stage of the fluid compressing step.

In order to overcome the above drawback, the following construction may be adopted. Namely, the internal fluid outlet port is provided in the rotor so as to pass each of the finishing ends of the spiral-like passages before each of the teeth of the pinion gear passes each of the finishing ends of the spiral-like passages. As a result, in the contact surface of the inner periphery of the worm and the outer periphery of the rotor and between the fluid outlet port which has already passed each of the finishing ends of the spiral-like passages when each of the teeth of the pinion gear passes it, and each of the finishing ends of the spiral-like passages, there is formed a sealing portion having length enough to prevent the compressed fluid from leaking into the low pressure side of the spiral-like passages.

However, in the compressor provided with the sealing portion, after the outlet port which discharges the compressed fluid passed each of the finishing ends of the spiral-like passages, the remaining fluid within the fluid sealing chamber is further compressed by each of the teeth of the pinion gear which is approaching to each of the finishing ends of the spiral-like passages.

Furthermore, in the worm type fluid rotating machine of this type, lubricating oil is used to lubricate the gaps between the spiral-like passages of the worm and the teeth of the pinion gear and to improve the sealing effect of the sliding portions of the machine.

The lubricating oil is also compressed in each of the finishing ends of the spiral-like passages which has been already cut off from the internal fluid outlet port, together with a compressed fluid in the final stage of the compressing step.

Since the lubricating oil has incompressibility, extremely high pressure occurs suddenly in each of the spiral-like passages. When the extremely high pressure occurs, abnormal noise generates and the pinion gear is likely to be bent or broken in its teeth portion which is the weakest portion in the fluid rotating machine.

Accordingly, an object of the present invention is to provide a small-sized worm type compressor.

Another object of the present invention is to provide an improved worm type compressor wherein the pressure within each of the spiral-like passages is prevented from being increased abnormally in the final stage of the compressing step.

Still another object of the present invention is to provide an improved worm type compressor which operates silently and exhibits excellent durability.

DESCRIPTION OF THE DRAWINGS

Other objects and advantages of the invention will become apparent from the following description of illustrative embodiments with reference to the accompanying drawings wherein:

FIG. 1 is a vertical section of a worm type compressor of the embodiment;

FIG. 2 is a section taken along the line II—II of FIG. 1;

FIG. 3 is a schematic view of a worm of a compressor of the embodiment developed in its circumferential direction;

FIG. 4 is a partial section taken along the line IV—IV of FIG. 1; and

FIG. 5 is a side view of a rotor of FIG. 1 from the under side thereof.

DETAILED DESCRIPTION

Figure 1:
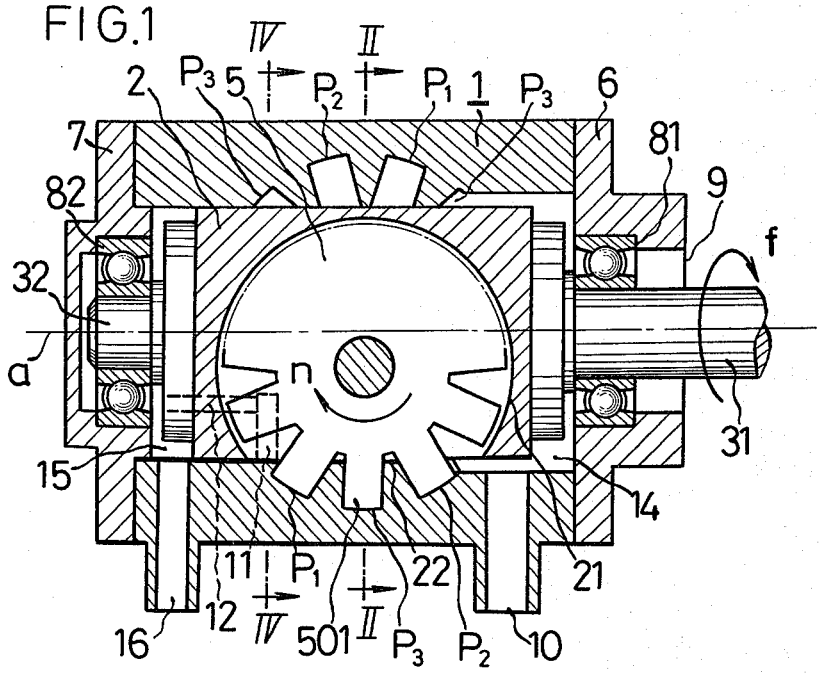
FIG. 1 to FIG. 5 show an embodiment of the present invention.
Figure 2:
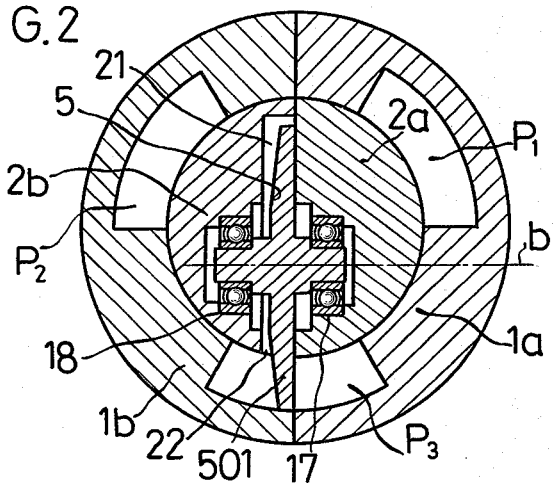

The compressor of the present invention comprises a cylindrical worm provided with a plurality of spiral-like passages for forming fluid sealing chambers in its inner periphery, a column-shaped rotor disposed coaxially within the worm and slidably contacted with the inner periphery thereof, a pinion gear disposed within a cavity provided within the rotor so that one portion of teeth of the pinion gear projects from an axially extending opening of the rotor and is engaged with the spiral-like passages, a fluid inlet means for introducing the fluid into the sealing chamber, a fluid outlet means for discharging the fluid from the fluid sealing chamber, including an internal fluid outlet port provided in the outer periphery of the rotor so as to be spaced from the axially extending opening of the rotor and a compressed fluid escape means provided in each of finishing portions of the spiral-like passages of the worm for letting one portion of the compressed fluid escape from each of the spiral-like passages when each tooth of the pinion gear passes each of the finishing portions of the spiral-like passages.

According to the fluid compressor of the present invention, by providing a compressed fluid escape means in each of the finishing portions of the spiral-like passages of the worm, a relatively long sealing portion can be obtained in the contact surface of the rotor and the worm and also extremely high pressure does not occur within the fluid sealing chamber.

Hereinafter, the present invention will be explained in accordance with an embodiment with reference to the drawings.

According to an embodiment as shown in FIGS. 1 to 5, in the inner periphery of a stationary cylindrical worm 1 serving as a casing, three spiral-like grooves or passages $P_1$, $P_2$, and $P_3$ are formed. The worm 1 is produced by combining two members 1*a* and 1*b* by means of bolts or the like. These spiral-like passages $P_1$, $P_2$ and $P_3$ are parallel with each other with a phase difference of 120°. The depth of each of spiral-like passages is maximum in the axially central portion of the worm and is gradually decreased in both end directions of the worm.

Within the cylindrical worm 1, a column shaped rotor 2 is disposed coaxially with the worm 1 so as to be slidably contacted therewith. Coaxial shafts 31 and 32 of the rotor 2 are supported by side plates 6 and 7 which are fixed to both ends of the worm 1 through bearings 81 and 82, bearing 81 being sealed by means of a shaft sealing device 9. The rotor 2 is rotated about an axis a by the shaft 31. The rotor 2 is composed of two members 2*a* and 2*b* which are combined in one body. Within the rotor 2, a cavity 21 having a circle shaped vertical section is provided. In the wall of the rotor 2, an axially, i.e. longitudinally, extending opening 22 is perforated so as to be communicated with the cavity 21.

Within the cavity 21, a pinion gear 5 is disposed. The pinion gear 5 is axially supported through bearings 17 and 18 so as to be rotated about an axis b which is perpendicular to and spaced from the axis a. Three teeth out of teeth 501 of the pinion gear 5 are always projected from the opening 22 of the rotor 2 and are engaged with the spiral-like passages $P_1$, $P_2$ and $P_3$ of the worm.

Thus, fluid sealing chambers are formed by the three spiral-like passages $P_1$, $P_2$ and $P_3$ of the worm 1, teeth 501 of the pinion gear 5 which are engaged with the spiral-like passages $P_1$, $P_2$ and $P_3$ and the outer periphery of the rotor 2.

In one end portion of the worm 1 serving as a casing, a fluid inlet pipe 10 is provided. The fluid inlet pipe 10 is communicated with a fluid inlet chamber 14 which is formed between the inner periphery of the worm 1 and the outer periphery of one end portion of the rotor 2. The fluid inlet chamber 14 is communicated with the beginning portion of each of the spiral-like passages $P_1$, $P_2$ and $P_3$ of the worm 1.

In the other end portion of the rotor 2, a triangle shaped internal fluid outlet port 11 is provided near but spaced circumferentially from one end portion of the axially extending opening 22 of the rotor 2. The internal fluid outlet port 11 is communicated with a fluid discharging chamber 15 which is formed between the inner periphery of the worm 1 and the outer periphery of the other end portion of the rotor 2 through a fluid outlet passage 12 which is provided within the rotor 2. The fluid discharging chamber 15 communicates with an outer fluid outlet port 16 which is provided through the worm 1. The internal fluid outlet port 11 is disposed in the outer periphery of the rotor 2 so as to be opposed to the finishing portions $P_{10}$, $P_{20}$ and $P_{30}$ of the spiral-like passage $P_1$, $P_2$ and $P_3$. The internal fluid outlet port 11 is communicated with each of the finishing portions of the spiral-like passages in turn as the rotor 2 is rotated relative to the worm 1. The internal fluid outlet port 11 is positioned in the outer periphery of the rotor so that when the tooth 501 of the pinion gear which travels in the spiral-like passage $P_2$ reaches the top end portion of the finishing portion $P_{20}$ of passage $P_2$, the internal fluid outlet port 11 is spaced from the top end portion thereof by a predetermined distance.

In each of the other spiral-like passages $P_1$ and $P_3$, there is the same relation between the position of the tooth of the pinion gear and that of the internal fluid outlet port 11 as described above.

Figure 3:
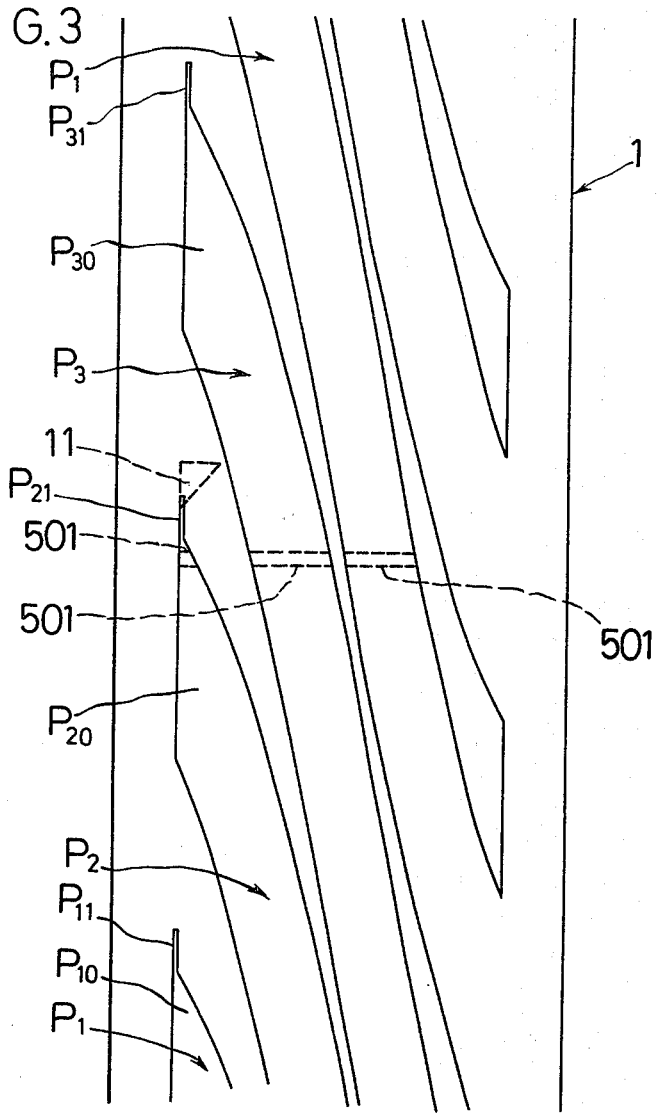
Figure 4:
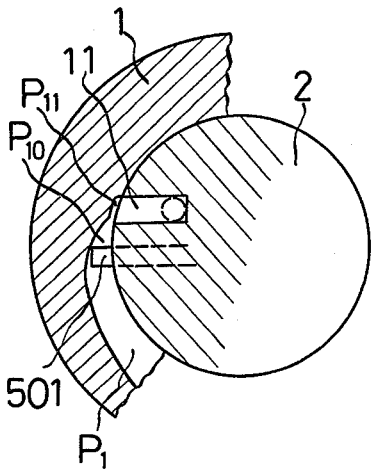
Figure 5:
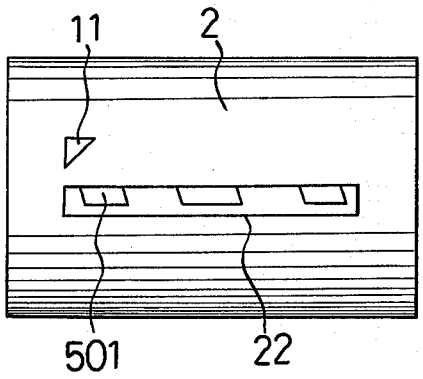

And as shown in FIGS. 3, 4 and 5, in the top or terminal end portion of each of the finishing portions $P_{10}$, $P_{20}$ and $P_{30}$ of the spiral like passages $P_1$, $P_2$ and $P_3$, shallow and narrow grooves $P_{11}$, $P_{21}$ and $P_{31}$ respectively are formed. These narrow grooves $P_{11}$, $P_{21}$ and $P_{31}$ extend from the top end portions of the spiral-like passsages along the productions of edge lines of the finishing portions of the spiral-like passages, namely in a circumferential direction of the worm.

Each of the grooves $P_{11}$, $P_{21}$ and $P_{31}$ extends to the position corresponding to the back end of the internal fluid outlet port 11 when each of the teeth of the pinion gear 5 reaches the top end portion of each of the spiral-like passages. Namely, the length of each of the grooves $P_{11}$, $P_{21}$ and $P_{31}$ in the circumferential direction of the worm is equal to the distance between the axially extending opening 22 and the internal fluid outlet port 11.

Hereinafter, the operation of the fluid compressor of the embodiment of the present invention will be explained.

When the shafts 31 and 32 are rotated in the direction shown by an arrow f about an axis a, the rotor 2 is rotated and the pinion gear 5, which is supported within the rotor 2 so as to be rotated about the axis b perpendicular to and spaced from the axis a while engaged with the spiral-like passages $P_1$, $P_2$ and $P_3$ of the worm 1, is revolved about the axis a of the rotor 2. At the same time, the pinion gear 5 is rotated clockwise (n direction of FIG. 1) about the axis b, guided by the spiral-like passages $P_1$, $P_2$ and $P_3$.

Each tooth 501 of the pinion gear 5 travels from the beginning side of the spiral-like passages $P_1$, $P_2$ and $P_3$ (the right side of FIG. 1) to the finishing side thereof (the left side of FIG. 1).

At first, the volume of the fluid sealing chambers formed by each of teeth 501, each of the spiral-like passages $P_1$, $P_2$ and $P_3$ and the outer periphery of the rotor 2 is increased as the depth of each of the spiral-like passages is increased so that fluid is introduced from the fluid inlet chamber 14 to each of the fluid sealing chambers.

Then, the volume of each of the fluid sealing chambers is decreased to discharge the fluid from each of the finishing portions of the spiral-like passages through the internal fluid outlet port 11.

Namely, as shown in FIG. 3 to FIG. 5, particularly FIG. 3, the internal fluid outlet port 11 opening in the rotor 2 travels along the finishing portions of the spiral-like passages $P_1$, $P_2$ and $P_3$ as the rotor 2 is rotated. And each tooth 501 of the pinion gear 5 which travels within each of the spiral-like passages $P_1$, $P_2$ and $P_3$, passes each of the finishing portions of the spiral-like passages $P_1$, $P_2$ and $P_3$.

For example, one tooth 501 of the pinion gear 5 reaches the finishing portion $P_{20}$ of the spiral-like passage $P_2$, the compressed fluid is discharged from the internal fluid outlet port 11 which is positioned so as to be communicated with the finishing portion $P_{20}$ of the spiral-like passage $P_2$. After the internal fluid outlet port 11 passes the top end portion of the spiral-like passage $P_2$, the tooth 501 continues to approach the top end portion of the spiral-like passage $P_2$ still more. As a result, the fluid including the lubricating oil in the passage $P_2$ is compressed still more and is discharged from the internal fluid outlet port 11 through the groove $P_{21}$.

Therefore, at this time, abnormally high pressure does not occur within each of the fluid sealing chambers.

After the internal fluid outlet port 11 passes the top end of the groove $P_{21}$ and the tooth 501 passes the top end portion of the spiral-like passage $P_2$, one portion of the compressed fluid including lubricating oil remains within the groove $P_{21}$ under pressure. After the tooth 501 passes the groove $P_{21}$, the compressed fluid including lubricating oil is fed into the following fluid sealing chamber formed again within the spiral-like passages $P_2$. As the rotor 2 is rotated still more, the internal fluid outlet port 11 approaches the finishing portion $P_{30}$ of the spiral-like passage $P_3$. Then, the compressed fluid is discharged from the internal fluid outlet port 11 in the same process as described above.

As described above, according to the embodiment of the present invention, abnormally high pressure does not occur in the fluid sealing chambers since the narrow grooves are provided so as to be communicated with the spiral-like passages.

As a result, the teeth of the pinion gear are not broken and abnormal noise does not occur but a sufficienty long sealing portion can be obtained around each of the narrow grooves in the final stage of the fluid compressing step.

In the compressor of the embodiment, the narrow grooves $P_{11}$, $P_{21}$, and $P_{31}$ are extended so as to be communicated with the internal fluid outlet port 11 until each of the teeth of the pinion gear 5 which travels the spiral-like passages reaches the top end portion of each of the finishing portions of the spiral-like passages. Narrow grooves of shorter length than the grooves $P_{11}$, $P_{21}$, and $P_{31}$ can be substituted therefor. The volume of the narrow grooves $P_{11}$, $P_{21}$, and $P_{31}$ mainly depends on the compression rate of the fluid in the final stage of the compressing step.

As described above, in the compressor of the present invention, a rotor is provided within a cylindrical worm having spiral-like passages in the inner periphery thereof and within the rotor, a pinion gear having teeth in the outer periphery thereof which travel within the spiral-like passages of the worm is provided. Therefore, the compressor of the present invention can be made small.

And according to the present invention, an internal fluid outlet port opens at the rotor so as to be opposed to and communicated with the finishing portions of the spiral-like passages of the worm in turn. Therefore, the compressed fluid can be discharged from all of the fluid sealing chambers by only one internal fluid outlet port. As a result, the fluid compressor of the present invention can be made simple.

Furthermore, according to the present invention, a compressed fluid escape means is provided in each of the finishing portions of the spiral-like passages of the worm for letting the compressed fluid escape from each of the spiral-like passages in the final stage of the fluid compressing step.

Therefore, a sealing portion having enough length can be obtained between the internal fluid outlet port and each of the finishing portions of the spiral-like passages. As a result, a great deal of compressed fluid can be prevented from leaking from the internal fluid outlet port into the low pressure side thereof when the compressed fluid is discharged into the internal fluid outlet port.

In addition, according to the present invention, by providing the compressed fluid escape means, abnormally high pressure can be prevented from occurring within the fluid sealing chamber in the final stage of the fluid compressing step. As a result, the teeth of the pinion gear are not broken and abnormal noise does not occur within each of the fluid sealing chambers.

Having now fully described the invention, it will be apparent to one of ordinary skill in the art that many changes and modifications can be made thereto without departing from the spirit or scope of the invention as set forth herein.

What is claimed is:

1. A worm type compressor comprising:

a cylindrical worm provided with a plurality of spiral-like passages in an inner periphery thereof;

said spiral-like passages being disposed with the same phase differences with each other, the depth of each of said spiral-like passages being maximum in the central portion of said worm in the longitudinal direction thereof and gradually decreasing in both end directions of each of said spiral-like passages;

a column-shaped rotor disposed coaxially within said worm and contacted with the inner periphery thereof so that said worm and said rotor may be rotated relatively to each other;

said rotor being provided with a cavity having an approximate circular shape in the axial direction thereof and an axially extending opening in the outer periphery of said rotor, which is communicated with said cavity;

a pinion gear disposed within said cavity and rotatably supported about an axis perpendicular to and spaced from the rotational axis of said rotor by a predetermined distance;

a portion of the teeth of said pinion gear projecting from said axially extending opening and being engaged within said spiral-like passages, respectively;

a plurality of fluid sealing chambers formed respectively by each of said spiral-like passages of said worm, each tooth of said pinion gear which is engaged with each of said spiral-like passages, and the outer periphery of said rotor, the volume of each of said plurality of fluid sealing chambers being varied according to the travel of each tooth of said pinion gear within each of said spiral-like passages of said worm;

a fluid inlet means for introducing the fluid into said fluid sealing chambers;

a fluid outlet means for discharging the fluid from said fluid sealing chambers;

said fluid outlet means comprising an internal fluid outlet port formed in the outer periphery of said rotor near but spaced circumferentially from said axially extending opening so as to be opposed to and communicated with each of the finishing portions of said spiral-like passages in turn as said rotor is rotated; and a compressed fluid escape means provided in each of said finishing portions of said spiral-like passages of said worm for letting one portion of the compressed fluid escape from each of said spiral-like passages when each tooth of said pinion gear passes each of said finishing portions of said spiral-like passages, said escape means comprising a narrow groove extending circumferentially in the inner periphery of said worm from and communicating with the terminal end of the corresponding finishing portion.

2. A worm type compressor according to claim 1, wherein:

said fluid inlet means comprises:

a fluid inlet chamber formed between the outer periphery of said rotor and the inner periphery of said worm and communicating with one end of each of said spiral-like passages in turn as the relative rotation of said worm and said rotor proceeds; and a fluid inlet port which is formed through the wall of said worm and which communicates with said fluid inlet chamber; and said fluid outlet means further comprises:

a fluid discharging passage which is formed within said rotor and communicated with said internal fluid outlet port;

a fluid discharging chamber which is formed between the outer periphery of said rotor and the inner periphery of said worm and communicated with said fluid discharging passage; and an outer fluid outlet port which is formed through the wall of said worm and which is communicated with said fluid discharging chamber.

3. A worm type compressor according to claim 1, wherein:

the length of the grooves in said circumferential direction is equal to the distance between said axially extending opening and said internal fluid outlet port.

* * * * *